United States Patent [19]

Pfizenmaier

[11] 3,973,294

[45] Aug. 10, 1976

[54] CLOSURE STRIP FOR FLEXIBLE-WALLED CONTAINERS

[76] Inventor: Walter Pfizenmaier, Industriestrasse, 7171 Schwab. Hall-Hessental, Germany

[22] Filed: Dec. 13, 1974

[21] Appl. No.: 532,529

[30] Foreign Application Priority Data

Dec. 17, 1973 Germany ..... 2362598
Nov. 13, 1974 Germany ..... 2453747

[52] U.S. Cl. ..... 24/30.5 T; 229/65; 229/87 B

[51] Int. Cl.[2] ..... B65D 77/16

[58] Field of Search ..... 229/65, 87 B; 24/30.5 T

[56] References Cited

UNITED STATES PATENTS

| | | | |
|---|---|---|---|
| 1,903,839 | 4/1933 | Royal | 229/65 |
| 2,973,597 | 3/1961 | Powell | 24/30.5 T |
| 3,037,310 | 6/1962 | Montalto | 40/21 R |

*Primary Examiner*—Stephen F. Garbe
*Attorney, Agent, or Firm*—Lerner, David, Littenberg & Samuel

[57] ABSTRACT

In a closure strip for retaining the open end of a flexible-walled container, such as a paper or plastic bag, in a closed condition, comprising one or more wire elements extending longitudinally of the strip and supported on a web of material, such as paper or plastics, the web is extending in at least one lateral direction to provide a large, substantially flat area on which information about the container contents can be enclosed.

10 Claims, 9 Drawing Figures

CLOSURE STRIP FOR FLEXIBLE-WALLED CONTAINERS

This invention relates to a closure strip for containers having flexible walls, such as plastics or paper bags and in particular relates to a closure strip having at least one plastically deformable element, for example of wire, of sufficient length to encircle the container at the desired location of closure, and supported by a web of material, such as paper or plastics material.

Closure strips of this form have been widely used in the past, such as for closing food containers or bags, for example, as used in the packaging of sliced bread. Both in Germany and other countries there is an ever-increasing demand for goods and in particular perishable foods to be not only marked with the price but also with the weight, packing date, etc. The known closures could have such information marked on them, but the surface area available is relatively small, since the web of material in which the deformable elements are usually embedded does not extend very substantially laterally of the elements, and, because the whole strip is wrapped around the container, only a portion of its total length can be printed on if the printed data is to be readily visible. If the strip were to be printed on over its whole length, the goods would have to be picked up and rotated as the information was read. In addition the ends of the closure strip overlap when the strip is used to close a container with the result that any information on these portions of the strip would be observed. Thus although existing closure strips could have the price or packing date, marked thereon extra details such as the weight etc. must be applied to the packaging at some other location.

The width of the web of material might be increased so as to give a large enough surface area to carry the required data, but this would lead to a reduction in the inherent rigidity of the closure strip and there would be a risk of the web of the strip bending.

It is also possible to add an appendage carrying the marked details by clamping it to the closure strip or forming it with an aperture through which the closure strip may be introduced, to secure the appendage to the container. The addition of separate appendages however naturally results in complicating the closure strip construction, and when made of paper can relatively easily tear off or become warped or bent, so that the marked information can no longer be readily seen.

The present invention aims at providing a closure strip having a sufficient surface area for receiving all the required information, but which also does not suffer the disadvantages of the known closure strips.

In accordance with the invention there is provided a closure strip for retaining an open end portion of a flexible-walled container in a closed condition, comprising one or more plastically deformable elongate elements extending longitudinally of the strip and supported by a self-supporting web of material, the elongate element being permanently deformable around a closed neck portion of the container to hold it closed, and a web portion extending laterally a substantial distance to one side of the element to provide a surface on which information can be marked.

The or each elongate element may be a length of wire or one plastically deformable strip whose width is substantially equal to the distance between the parallel wire elements of conventional clip closure strips may be used.

A closure strip of this form can be basically constructed with two parallel elements spaced apart from one another as in conventional closure strips, and it can also be substantially made in the same way as before. The closure strip can reliably be wrapped in the usual manner around the container at the desired closure place, but the surface available for marking on is substantially increased in comparison with conventional constructions.

In one preferred embodiment of the invention, a portion of the web directly connected to the element is connected to the laterally extending web portion through a narrow neck so that the element can be wrapped around a container while the laterally extending portion remains substantially flat.

Some embodiments of the invention will now be described by way of example with reference to the accompanying drawings, in which.

Figure 3A:
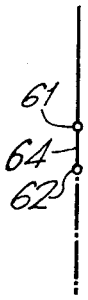
FIG. 3 is a plan view of a strand of identical closure strips integrally connected to one another.
Figure 3:
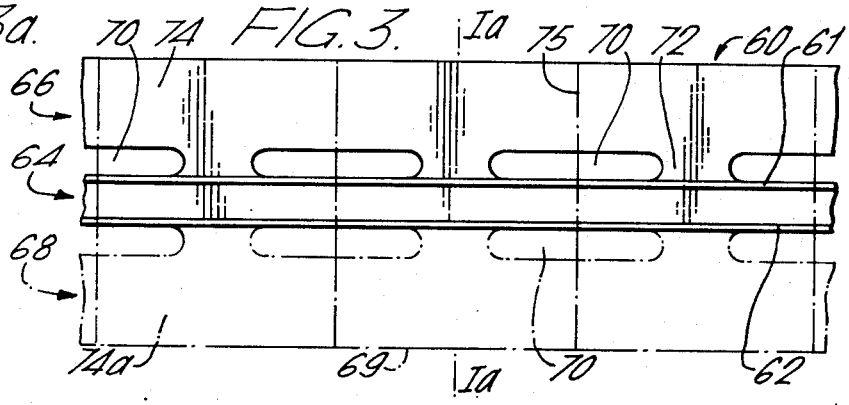
Figure 4:
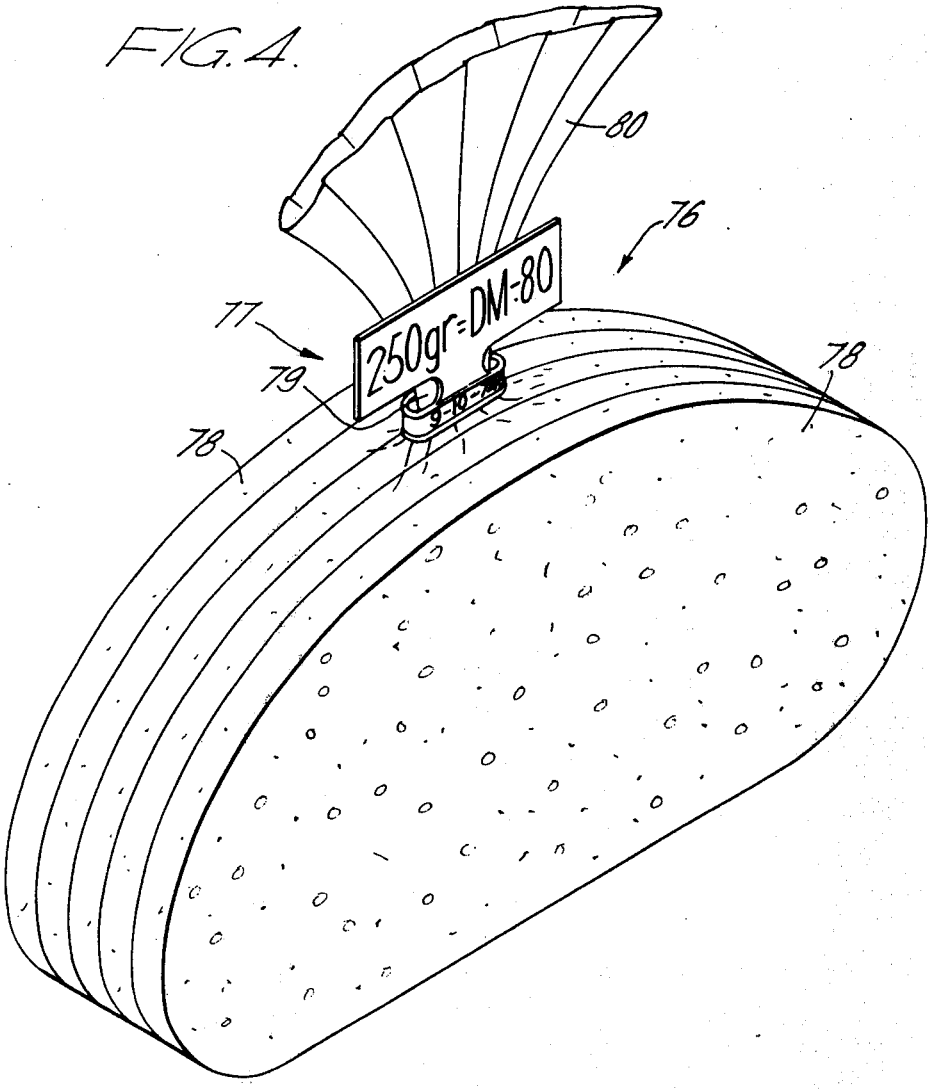

FIG. 3*a* is a cross-section taken along the line III*a*—III*a* of FIG. 3;

FIG. 4 is a perspective view showing a bread bag closed by the closure strip of FIGS. 3 and 3*a;*

Figure 6A:
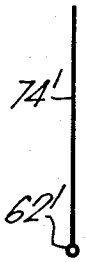
Figure 6:
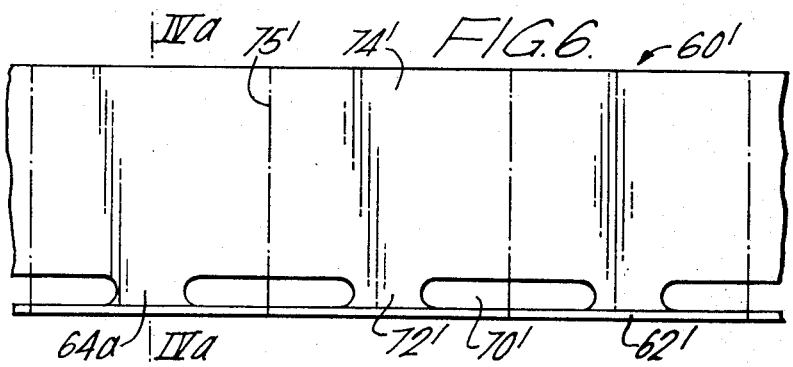
Figure 7:
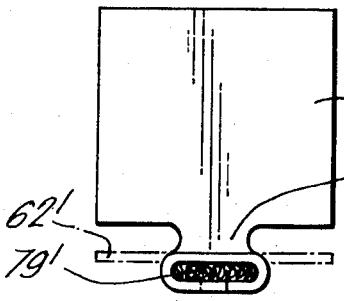
Figure 5:
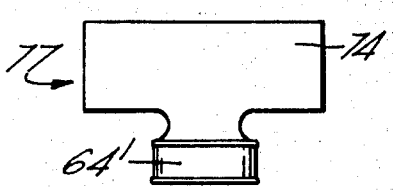

FIG. 5 is a plan view of a closure strip separated from the strand illustrated in FIG. 3;

FIG. 6 is a plan view of a strand of closure strips of an alternative construction;

FIG. 6*a* is a cross-section taken along line VI*a*—VI*a* of FIG. 6; and FIG. 7 is a plan view of a closure strip separated from the strand of FIG. 6 and applied to a container.

Figure 1:
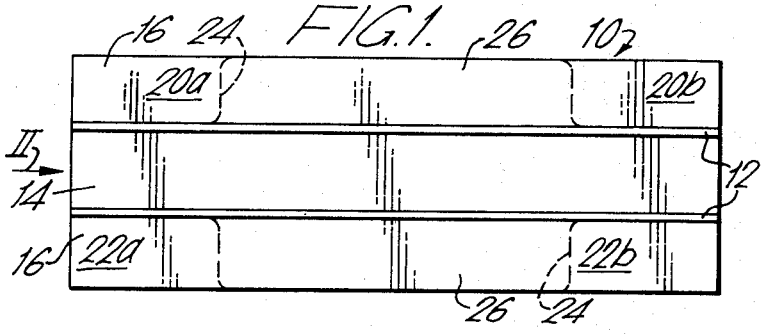
FIG. 1 is a plan view of a first closure strip according to the invention in the flat condition.

The closure strip 10 shown in FIG. 1, has two plastically deformable wire elements 12 extending in spaced, parallel relationship longitudinally of the strip. The length of the closure strip is just enough to be wrapped around a flexible-walled container or bag to be closed, at the desired closure location, the wires 12 ensuring that the strip remains in position after it has been bent around the bag neck.

A web of material 14 for example paper or plastics material extends between the two wires to form a central web portion connected to the wires 12 along its longitudinal edges. This web of material can take up the curvature of the wire elements when the closure strip is bent. The width between the wires is such that the closure strip 10 has an inherent rigidity which resists bending about a longitudinal axis. If the width of the web 14 was increased however, to such an extent that the comparatively small surface of the central web portion available to be printed or otherwise marked upon became so large that all the required details could be accommodated, this rigidity would be lost and therefore the performance of the closure strip 10 would be impeded.

The layer of material 14 is instead extended transversely of the longitudinal direction of the closure strip 10 beyond the two wires 12 by a distance substantially equal to the distance between the wires, to form rectangular web portions 16 whose surface areas are substantially equal to the surface area of the central web portion. As a result the area available to be printed on is increased without reducing the inherent rigidity of the closure strip. Since the width of the rectangular area 16 is substantially equal to the width of the web 14 between the wires, adequate inherent rigidity of the areas 16 is also ensured.

When the closure strip 10 is wrapped around a bag neck, the areas 16 may interfere so the end zones 20*a*, 20*b*; 22*a*, 22*b* can be separated along chain lines 24, to leave lugs 26. The lugs 26 correspond to those parts of the elongate portions 16 which are useful for receiving printed information which can subsequently be read without having to turn the goods over. The narrow end portions of the strip between the zones 20*a*, 22*a*, 20*b*, 22*b* enable the closure strip 10 to be manipulated more easily when it is applied to the container to be closed.

In the closure strip shown in FIGS. 3 to 5 a strip 60 includes a web of material with a central portion 64 intermediate the wire elements 61, 62 and laterally projecting portions 66 and 68, the portion 68 having a greater width as indicated by the chain lines 69. Chain dot separating lines 75 indicate the connections between the individual closure strips of the strand shown in FIG. 3. The web of material encloses the two plastically deformable wires 61, 62 for securing the strip around the neck of a bag in convention manner.

The lateral extension portions have slots 70 at their inner edges adjacent the wires 61, 62, the slots extending longitudinally of the strand symmetrically to either side of the interconnection lines 75 and have rounded ends. Thus longitudinally adjacent slots 70 define neck pieces 72 which connect the central web portion 64 with the lugs 74.

Although the closure strip has been described as having two wires, a single wire or even more than two wires could be used.

Except for the wires 61, 62, the strand 60 is preferably made of a material having suitable inherent rigidity, such as paper, impregnated if necessary or plastics sheet.

The individual closure strips are separated from the strand by cutting along the separating line 75, the finished closure strips having preferably been provided with the required details such as the weight, price, packing date, keeping date, or even advertisment before they are cut from the strand.

A conventional bag 76 of transparent plastics material is shown in FIG. 4 containing a number of slices of bread 78. To close the bag 76 it is gathered together at its open end to form a neck 79 with an adjoining ruche 80, and the wires 61, 62 are bent around the neck 79. The wires remain in the deformed position due to their plastic deformability. Due to the slot recesses 70, which take on a substantially U-shaped form after separation of the individual strips the lug 74 is not deformed during the bending of the wires and central web portion 64 and remains substantially flat over its entire area to provide a relatively large surface area available for receiving printed information. If lugs are provided on each edge of the strip the additional lug 74*a* can bear further information. After the application of such a closure strip to the bag 76, lower lug 74*a* would not of course lie in the same plane as the upper lug 74, but with suitable bending in the region of the neck 72*a* it may still provide a substantially flat area.

Figure 2:
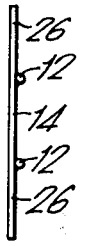
FIG. 2 is an end view of the closure illustrated in FIG. 1.

In the closure strip shown on its own in FIG. 5, as it appears in use, the central web portion 64′ has for example a width of 8 mm, the neck a height of 5 mm and the adjoining lug 74 a height of 15 mm, with a length of, for instance, about 40 mm, so that a continuous flat surface for printing on of 6 $cm^2$ is available for printing as opposed to 1.5 to 3 $cm^2$ in a closure strip as illustrated in FIGS. 1 and 2.

In the strand of closure strips shown in FIG. 6 a single wire 62′ is embedded in a layer of material, the wire 62′ being adjoined on one side by neck pieces 72′ and lugs 74′ whose lateral width is about twice the width of the lugs 74 of the strips illustrated in FIG. 3. Slots 70′ are provided in the strand to define the neck pieces 72′. The strand 60′ is separable along the separating lines 75′, into individual closure strips.

FIG. 7 shows how one of the closure strips of FIG. 6 is attached to a bag neck 79′, the wire 72′ is bent around the bag neck 79′, whereas the neck piece 72′ and the lug 74′, remain substantially undeformed and flat.

In the embodiment of FIG. 3 the lugs 74, 74*a* on the one hand and the central web portion 64 on the other can be two separate pieces, each being given a layer of self adhesive glue in an overlapping zone, by means of which the two components are releasably connected to one another so that if necessary, they can be separated without destroying the strip.

For mechanised application of the closure strips 10, 60 they can be in strands wound into rolls and drawn off the rolls in the direction of a closure machine. The slots 70, 70′ can be cut out before the strands are wound up, or alternatively they can be omitted and formed by punching when the individual closure strips are separated from the strands along separating lines 75; 75′. The lugs 74 (74*a*; 74′) can also be printed at the closure station.

If only a relatively small number of bags are to be closed by closure strips, it may be more convenient for the closure strips to be fed to the closure station individually in their final form and printed on, with the or each wire element being bent into substantially U-shape, whereby the element can be laid readily around the preformed bag neck and then the free ends closed together. This is particularly suited to the case in which the strips are located on the bags manually.

The described closure strips have the advantage that on the one hand a bag can be labelled with details which differ in dependence with its contents, and on the other hand the bag can be closed in a single operation. There is no need to provide extra appendages carrying details or to mark the required details directly on to the bag, which is only economical where large quantities are involved. Nor is there any need to stick labels on to unprinted bags, which requires extra machines and labour. Self-adhesive labels which also could be used are disadvantageous inasmuch as they are expensive and also require a special operation for their application.

I claim:

1. A closure member for retaining an open end portion of a flexible-walled container in a closed condition, comprising a rigid, self-supporting web of material, and a deformable elongated element supported by said web and extending in the longitudinal direction of the member, said element including two ends which are both permanently deformable around a closed neck portion of the container to hold it closed, said web including a rigid portion extending laterally a substantial distance to one side of said element to provide a surface for carrying information about the container contents, said web further including a neck portion directly attached to said element, and said neck portion being directly connected to said laterally-extending rigid web portion.

2. A closure member as claimed in claim 1, wherein two said elongated elements are supported by said web in spaced parallel relationship, a continuous self-supporting central portion of said web located between said elements and having opposed longitudinal edges being connected to said elements along said longitudinal edges.

3. A closure member as claimed in claim 2, wherein said laterally extending web portion extends outwardly of one said element in the form of a lug, said lug having a longitudinal length less than the length of the member.

4. A closure member as claimed in claim 3, wherein the lug is disposed at a medial position along the length of the member.

5. A closure member as claimed in claim 1, wherein longitudinally extending slots are provided in said rigid web and interrupt a continuous connection between said rigid web portion attached to said element and said laterally extending rigid web portion to define said neck portion.

6. A closure member as claimed in claim 5, wherein said slots are aligned, U-shaped recesses in the opposite ends of the strip.

7. A closure member as claimed in claim 1, wherein said elongated element is a length of wire.

8. A closure member according to claim 1, wherein said web of material is paper or plastics material.

9. A closure strip comprising a plurality of closure members connected end-to-end to form a strip, said closure members adapted to retain an open end portion of a flexible-walled container in a closed condition, each of said closure members including a rigid, self-supporting web of material and a deformable elongated element supported by said web and extending in the longitudinal direction of the member; each of said elements including two ends which are both permanently deformable around a closed neck portion of the container to hold it closed, each of said webs including a rigid portion extending laterally a substantial distance to one side of said element to provide a surface for carrying information about the container contents, said closure members being connected along weakened lines, and the rigid web of each of said closure members including longitudinally-extending slots at the opposite ends of each of said closure members.

10. A closure strip in accordance with claim 9, wherein the slots of each of said closure members is open-ended, and the open end of each of said slots constructed and arranged to adjoin the open end of a slot in an adjacent closure member.

* * * * *